United States Patent [19]

Barry et al.

[11] Patent Number: 4,852,452

[45] Date of Patent: Aug. 1, 1989

[54] DEFENSE TO LASER LIGHT IRRADIATION

[75] Inventors: James D. Barry, Los Angeles; Chandler J. Kennedy, Huntington Beach, both of Calif.

[73] Assignee: The United States of America as represented by the Secretary of the Air Force, Washington, D.C.

[21] Appl. No.: 338,198

[22] Filed: Jan. 6, 1982

[51] Int. Cl.[4] ..... F41F 5/00; G01D 5/34; G02B 26/02

[52] U.S. Cl. ..... 89/1.11; 250/229; 350/269

[58] Field of Search ..... 350/290, 269, 600; 89/36 R, 36 N, 1.11; 455/605; 250/201, 229

[56] References Cited

U.S. PATENT DOCUMENTS

| | | | |
|---|---|---|---|
| 2,354,665 | 8/1944 | Church et al. | 89/36 N |
| 3,245,315 | 4/1966 | Marks et al. . | |
| 3,497,286 | 2/1970 | Morton et al. . | |
| 3,807,659 | 4/1974 | Winfrey | 244/3.16 |
| 3,807,832 | 4/1974 | Castellion | 350/290 |
| 3,833,893 | 9/1974 | Rajchman | 350/102 |
| 3,986,690 | 10/1976 | Milling | 332/7.51 |
| 4,112,300 | 9/1978 | Hall, Jr. et al. | 250/330 |
| 4,222,632 | 9/1980 | Eichweber | 350/102 |

*Primary Examiner*—Stephen C. Buczinski

*Attorney, Agent, or Firm*—Thomas L. Kundert; Donald J. Singer

[57] ABSTRACT

A satellite defends itself by having a plurality of corner cube retroreflectors with shutters, each having a laser light sensor. It is assumed that the attacker first must obtain positional and range information with a pulsed laser. When one of the sensors detects these low power laser pulses, it causes the shutter of the corner cube array to open and return the pulses with sufficient strength to saturate or damage the attack sensors.

3 Claims, 3 Drawing Sheets

DEFENSE TO LASER LIGHT IRRADIATION

RIGHTS OF THE GOVERNMENT

The invention described herein may be manufactured and used by or for the Government of the United States for all governmental purposes without the payment of any royalty.

BACKGROUND OF THE INVENTION

This invention relates to a defense system for a satellite to protect itself from an attack by laser light irradiation.

A satellite may be the target of satellite borne laser light threats. The laser light irradiation could damage the solar cell arrays, could cause harm to the passive thermal collectors as well as severely damaging any electro-optical functions of the satellite.

In order for an attacker to pose a threat, it must first obtain accurate positional and range information on the satellite to be attacked. Presumably, the range and positional data will be acquired by laser since angular accuracies of the order of $1\times10^{-6}$ radian will be necessary to preclude untenable laser power requirement to cause damage, and range information to less than 100 meters to verify power density to cause damage. Consequently, the initial period of an attack will be used to obtain range and position data using a pulsed laser of relatively low power.

A Laser Defense and Counter-measure System for aircraft is disclosed in U.S. Pat. No. 3,986,690 by Milling, in which the aircraft has a second skin formed as a retroreflector. The retroreflecting elements are formed in a thin sheet of bright structural aluminum. U.S. Pat. No. 3,807,659 by Winfrey discloses a shutter means for use with a laser beam.

SUMMARY OF THE INVENTION

The object of the invention is to provide an inexpensive defense of a satellite against satellite borne laser light threats.

The invention relates to a simple device, including a sensor and shuttered corner cube, which when activated allows a satellite defense to operate against a second satellite attempting to cause harm to the first by means of laser light irradiation. The use of the device will eliminate the threat capability of the attacking satellite by rendering useless its ranging, pointing and aiming sensors. It is assumed that the attacker satellite must first positionally locate and range accurately to a target satellite by means of a relatively low power laser prior to the use of the disabling intense laser light. The satellite being attacked uses a low power laser sensor to detect the range illumination from the attack satellite. The detector provides a signal which causes the corner cube shutter to open, thereby exposing it to the ranging illumination. The ranging laser light is thereby highly reflected directly back to its source. The so returned signal is greater than $10^9$ higher than signals expected back at the attacking satellite thereby saturating and damaging the attacker satellite range sensors. The attacker satellite can therefore no longer determine range and positional information so that its function is rendered useless.

DETAILED DESCRIPTION

Figure 1:
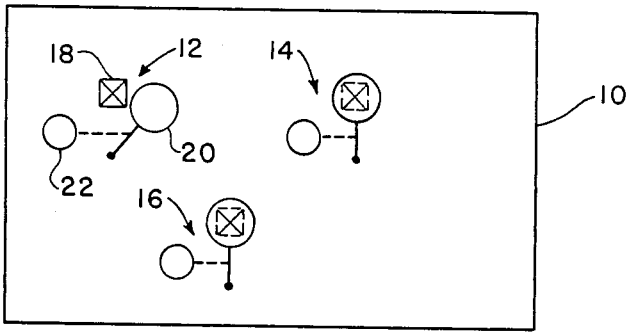
FIG. 1 is a symbolic diagram of a satellite with a corner cube defense system.

A satellite used for defense purposes may be the target of satellite borne laser light threats. The laser light irradiation could damage the solar cell arrays, could cause harm to the passive thermal collectors as well as severely damaging any electro-optical functions of the satellite.

In order for an attacker satellite to pose a threat, it must first obtain accurate positional and range information of the satellite to be attacked. It is assumed that the range and positional data will be acquired by laser since angular accuracies of order $1\times10^{-6}$ radian will be necessary to preclude untenable laser power requirement to cause damage, and range information to less than 100 meters to verify power density requirements to cause damage. Consequently, the initial period of an attack will be used to obtain range and position data using a pulsed laser of relatively low power.

It is assumed that the threat will be by $CO_2$ laser irradiation due to its high power capability and calculations will be based on that assumption. This does not preclude a similar concept from being applicable to other gas and/or solid state lasers. The disclosure is intended to be applicable to any such laser threat.

The laser power illuminating the target satellite must be sufficient to normally obtain a reflection so that a portion of the signal may be returned to the attacker satellite where it is detected (by assumed quadrant arrays) to provide the range and position information. The laser power intercepted by the target satellite is given by $$P_T = \frac{P_A A_T}{\pi \theta_A^2 R^2}$$

where $P_A$ is the laser power transmitted by the attacker satellite, $A_T$ is the effective area of the target satellite, $\theta_A$ is the beam divergence of the attack satellite laser beam and R is the range separating the two satellites.

The laser power returned to the attack satellite is given essentially by $$P_R = \frac{Q P_T A_A}{\pi \theta^2 R^2}$$

where Q is the reflection efficiency of the target satellite, $\theta$ is the return scattering angle, up to a full hemisphere, $2\pi$ steradians, and $A_A$ is the collection area of the attack satellite range and position sensor optics. So that, $$P_R = \frac{P_A A_T Q A_A}{\pi^2 \theta^2 \theta_A^2 R^4}$$

In a normal laser light quadrant detector, the signal level must be high enough to overcome background optical noise as well as detector and electronic thermal noise. This value per detector quadrant must be of order 128 photo electrons per laser pulse. We assume a quadrant laser light detector with an effective quantum efficiency of about 30%.

The total light ($P_R$) collected from that returning from the target satellite must be greater than $4\times3.3\times128$ photons per pulse. Power has units of joules/sec and is equal to $Nhc/\lambda$ where N is the number of photons/sec and $hc/\lambda$ is the energy per photon; h is Planck's constant ($h=6.625\times10^{-34}$ Joule-sec) and c is the speed of light ($c=3\times10^8$ m/sec). We need not be concerned here with optical losses which we recognize as requiring more signal margin.

We may solve for the required power, assuming $A_T \neq 0.3$ m$^2$ $Q \neq 10\%$ $A_A \neq 0.1$ m$^2$ $A \neq 100\times10^{-6}$ radians $R \neq 1$ km, 10 km, 100 km, 1000 km By inverting equation (1) and using the above assumptions, we find that the required laser energy is (assuming a near infrared Nd:YAG illumination laser with $\lambda=1.06$ micrometer and $hc/\lambda=1.875\times10^{-19}$ joule/photon).

$P_A$ (1 km)$\neq 2\times10^{-7}$ Joule/pulse $P_A$ (10 km)$\neq 2\times10^{-3}$ Joule/pulse $P_A$ (100 km)$\neq 2\times10^{1}$ Joule/pulse $P_A$ (1000 km)$\neq 2\times10^{5}$ Joule/pulse The number of pulses required per second to obtain the desired range and position information will determine the total laser power required for that function. The number of pulses must be sufficient to allow the $1\times10^{-6}$ radian positional accuracy and the 100 meter range accuracy. Since satellites do have internal noise and jitter with frequency components to the kilohertz range, it is assumed that the laser would operate at a pulse rate of $10^{+2}$ to $10^{+4}$ pulses/second.

It is assumed that the target satellite is equipped with sensors to detect laser irradiation during the ranging period. The target satellite detectors must be electronically connected so that a signal is generated after 3 to 10 successive ranging laser illuminations are detected. The signal is used to open a shutter which covers a corner cube array. The corner cube array is highly reflective to the laser illumination and its property of returning light to its source is utilized. The corner cube array return beam divergence is assumed to be $\theta_C$ about $100\times10^{-6}$ radians, to have a reflectivity of $Q_C=99\%$ and an area of 0.1 square meters. That is, in the previous notation Q is replaced by $Q_C$, $\theta$ is replaced by $\theta_C$, and $A_A$ by $A_C$.

Equation (1) is thus modified by the ratio $(\theta^2/QA_C)(Q_CA_C/\theta^2C)=6\times10^9$. That is, $P_R$ is increased by $6\times10^9$ and the signal per quadrant is no longer 128 photons/pulse but $6\times10^9$ higher.

We assume that the range and positional quadrant detectors of the attack satellite have sufficient dynamic range to allow for 1 km$<R<$1000 km, that is, from equation (2), over $10^{-7}$ Joule/pulse to about $10^5$ Joule/pulse, a range of $10^{12}$. The use of the corner cube array on the target satellite would require a range of $10^{10}$ higher, that is $10^{22}$.

Since a dynamic range of $10^{22}$ is quite impractical, damage or saturation of the quadrant amplifiers or detectors will certainly occur. Consequently, the attack satellite cannot complete the range and positional inquery mode and is rendered useless. It cannot attack without accurate position and range information. The disclosed concept can therefore defend a target satellite against satellite borne laser light attack.

We recognize that the use of an unshuttered corner cube array on a target satellite might be used to countermeasure a satellite laser light preattack if the attacker were expecting low reflections. This could be countered by the attack satellite by using lower transmitted powers. The use of the shuttered corner cube array will allow the best defense for all situations of laser light ranging and position determination.

FIG. 1 is a symbolic representation of a satellite having a plurality of defense devices 12, 14, 16, each of which includes a corner cube reflector 18, which has a shutter 20, and a laser light sensor 22. The shutter is shown symbolically open for device 12 and shut for devices 14 and 16.

Figure 2:
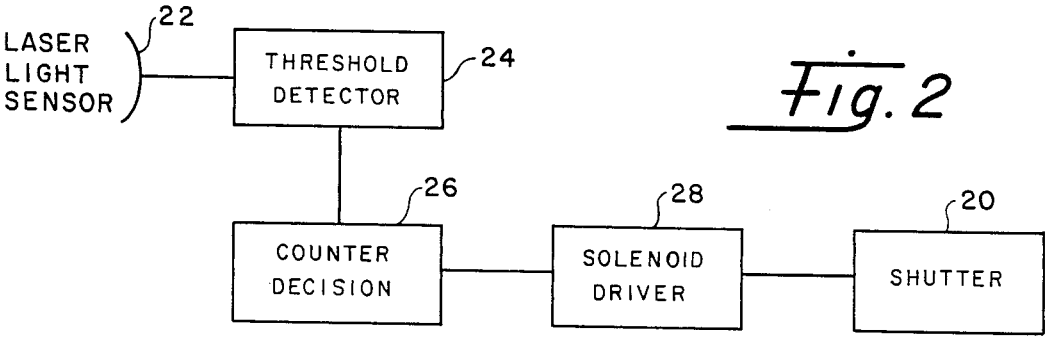
FIG. 2 is a block diagram of the circuit between the sensor and the shutter for each corner cube device.

As shown by a block diagram in FIG. 2, the laser light sensor is coupled to the shutter 20 by a simple circuit. The threshold detector 24 responds to received laser pulses at the sensor above a threshold value and steps a counter and decision block 26, which in turn actuates a solenoid driver 28 to operate a solenoid which moves the shutter 20.

Figure 3:
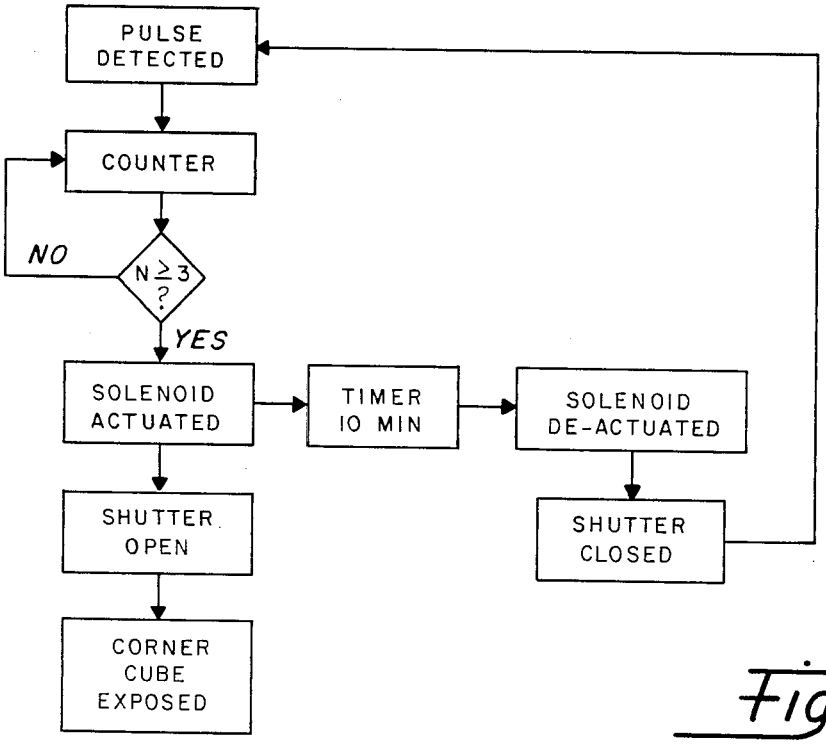
FIG. 3 is a flow chart for the circuit of FIG. 2.

A flow chart of the operation is shown in FIG. 3. When the number of pulses is equal to or greater than a given number, such as three, the solenoid is actuated and the shutter is opened to expose the corner cube. At the same time a timer is started to de-actuate the solenoid and close the shutter after an appropriate interval, such as ten minutes.

Figure 4:
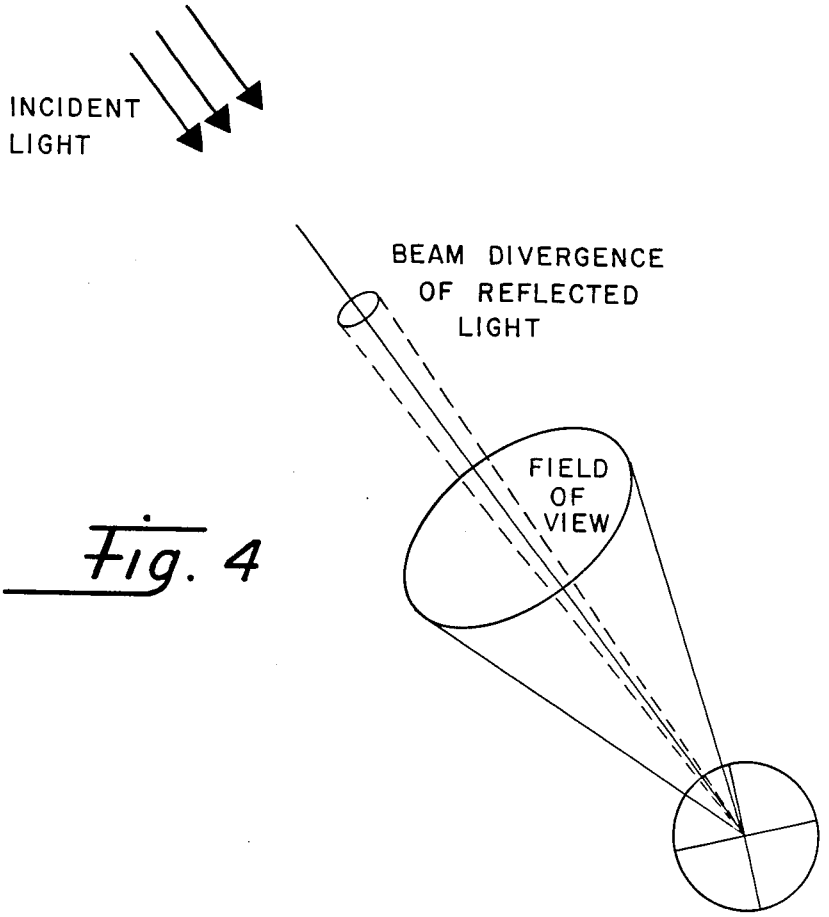
FIG. 4 is a diagram showing retroreflection by a corner cube.

FIG. 4 is a diagram showing the action of a retroreflector or corner cube. Light incident on a corner cube is reflected back along the incidence vector as long as the light is within its field of view. The reflected light will have a beam divergence defined by physical properties of the retroreflector.

Figure 5:
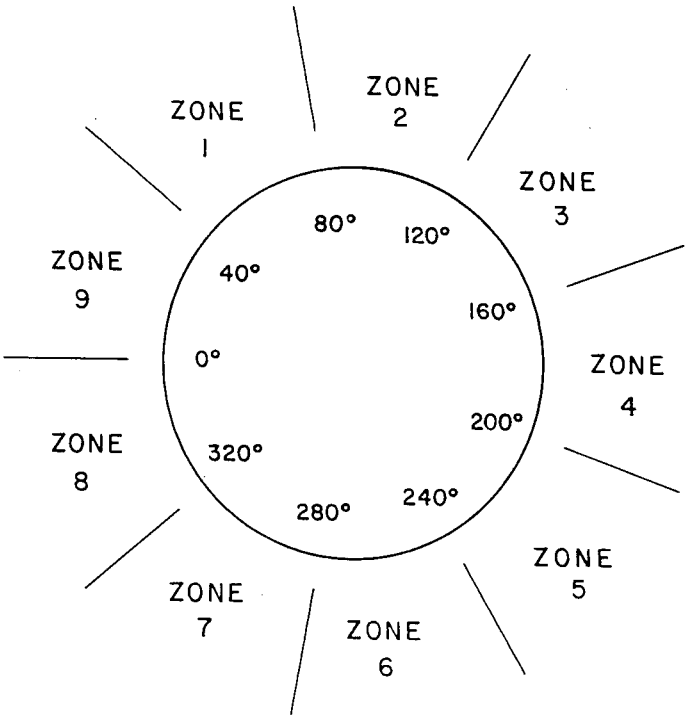
FIGS. 5, 6 and 7 are diagrams showing placement of the corner cube devices on a cylindrical satellite.

It will be assumed that the retroreflectors each have a normal $2\frac{7}{8}$ inch diameter with a field of view of $\pm20°$ and a return beam divergence of 20 arcseconds which is approximately 100 microradians. To provide full spherical coverage for a cylindrical satellite would then require nine zones as shown in an end view in FIG. 5. The spherical coverage is required so that a beam can be retroreflected independent of the orientation of the spacecraft. The geometric location of the corner cubes will depend on the geometry of the spacecraft 10 and the physical parameters of the retroreflectors 18, such as the size needed, the field of view, and the reflected beam divergence. The retroreflection assumed in the analysis herein was for a divergence of about $100\times10^{-6}$ radians, however, commercially available units now provide a beam divergence of about $10\times10^{-6}$ radians. The specific divergence value used can modify the return power and affect the required retroflective area. Commercial units such as those available from Pyramid Optical Corporation, 1732 McGaw Ave., Irvine, Calif. 92714, have a diameter of $2\frac{7}{8}$ inch of area equal to 41.88 Cm$^2$.

The concept is applicable to all optical wavelengths, not just 10.6 micrometers. All laser sources may be covered by use of the appropriate coating reflectivity.

Figure 6:
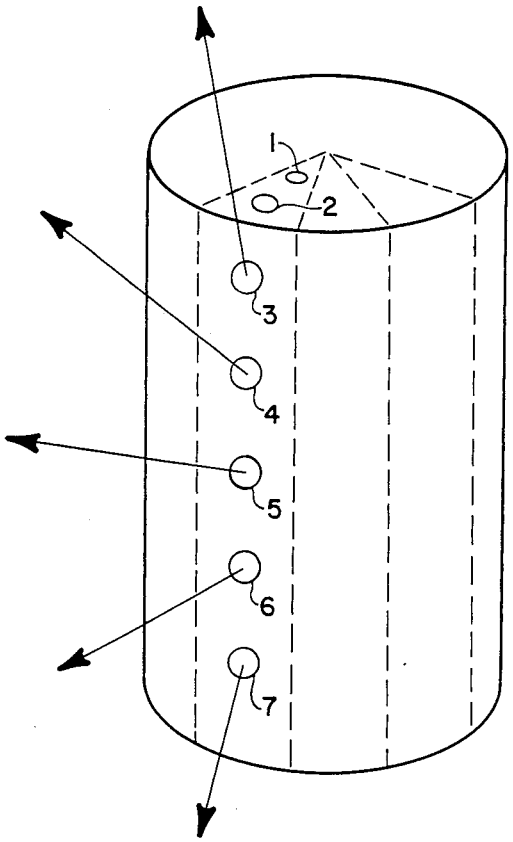
Figure 7:
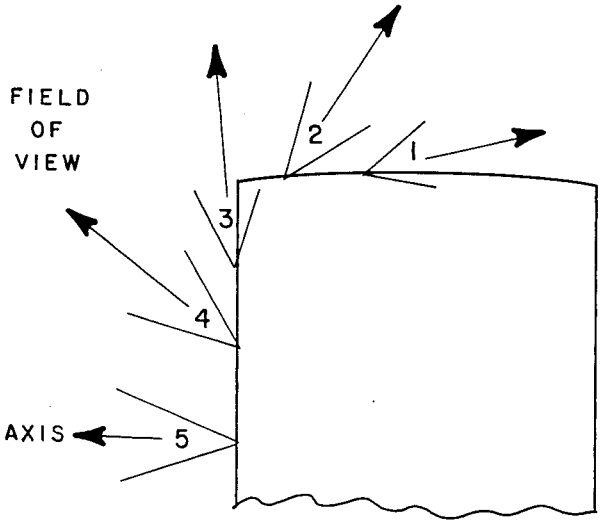

One configuration of corner cube retroflector devices is shown in FIGS. 6 and 7, for a cylindrical spacecraft 10. FIG. 6 shows the corner cubes devices 1–7 on one end and the cylindrical surface for one of the nine zones of FIG. 5, with the retroreflectors placed about the body to give global coverage. The zone of course continues on the other end with devices 8 and 9 not shown. The arrows show the retroflector axis. FIG. 7 is a rotation of FIG. 6 showing the field of view coverage and the axis for each of the corner cubes 1–5.

Thus, while preferred constructional features of the invention are embodied in the structure illustrated herein, it is to be understood that changes and variations may be made by the skilled in the art without departing from the spirit and scope of my invention.

We claim:

1. A defense system for a unit to protect itself against an attacker which uses a laser beam and an attack sensor detecting reflection of the laser beam to determine the direction and range to said unit; said defense system comprising:

a plurality of corner cube reflectors each having a shutter and an associated laser illumination detector, with circuit means coupled to the laser illumination detector and to the shutter operative in response to a given condition indicating detection of said beam to open said shutter so that the laser beam is reflected back with power several orders of magnitude greater than would be expected for reflection from said unit, whereby the reflection has sufficient strength to saturate said attack sensor.

2. A defense system as set forth in claim 1, wherein said circuit means includes a counter, and a threshold detector coupled between the laser illumination detector and the counter to detect and count pulses of said laser beam, and said given condition is the counting of a predetermined number of pulses.

3. A defense system as set forth in claim 2, wherein the circuit means further includes timing means coupled to close the shutter after a predetermined time interval.

* * * * *